US009664487B2

(12) United States Patent
Whitworth et al.

(10) Patent No.: US 9,664,487 B2
(45) Date of Patent: May 30, 2017

(54) FIREARM CLEANING SHELL

(71) Applicants: James Curtis Whitworth, Commerce Township, MI (US); John Biafore, Jr., Grand Blanc, MI (US)

(72) Inventors: James Curtis Whitworth, Commerce Township, MI (US); John Biafore, Jr., Grand Blanc, MI (US)

( * ) Notice: Subject to any disclaimer, the term of this patent is extended or adjusted under 35 U.S.C. 154(b) by 0 days.

(21) Appl. No.: 14/792,127

(22) Filed: Jul. 6, 2015

(65) Prior Publication Data

US 2017/0010081 A1 Jan. 12, 2017

(51) Int. Cl.
*F42B 14/00* (2006.01)
*F42B 5/24* (2006.01)

(52) U.S. Cl.
CPC ..... *F42B 14/00* (2013.01); *F42B 5/24* (2013.01)

(58) Field of Classification Search
CPC .... F42B 5/24; F42B 14/00; F42B 8/02; F42B 14/04; F41A 29/00
USPC ..... 102/529
See application file for complete search history.

(56) References Cited

U.S. PATENT DOCUMENTS 938,836 A * 11/1909 Fessenden ..... F42B 5/24 102/442
1,039,774 A * 10/1912 Melander ..... F42B 5/24 102/511
1,231,227 A 11/1916 Williams
1,495,008 A 5/1924 Feagin
2,047,897 A 7/1936 Symes
2,660,002 A 11/1953 Farley
2,765,740 A * 10/1956 Norman ..... F42B 5/24 102/442
3,055,268 A * 9/1962 Rosenthal ..... F41A 1/08 102/522
3,147,708 A * 9/1964 Ferguson ..... F41A 29/00 102/442

(Continued)

FOREIGN PATENT DOCUMENTS

RU 2293943 C2 2/2007
WO WO 2014186308 A1 11/2014

OTHER PUBLICATIONS

U.S. Appl. No. 15/061,741, Not Publ'd, Whitworth, J.C.
U.S. Appl. No. 14/728,423, Not Publ., Whitworth, James C.

*Primary Examiner* — Troy Chambers
*Assistant Examiner* — Bridget Cochran
(74) *Attorney, Agent, or Firm* — Vincent Re PLLC

(57) ABSTRACT

A bore cleaning projectile cleans a bore of a firearm as the projectile is propelled down the bore. The projectile includes a frame including a lower charge cap, a tapered cone-shaped center shaft portion, and an end cap. The projectile further includes a propellant providing a force to push the device down the bore of the firearm and at least one cleaning agent situated around the tapered cone-shaped center shaft portion. The center shaft portion includes a narrower diameter at a longitudinally forward portion of the center shaft portion and a wider diameter at a longitudinally rearward portion of the center shaft portion. The cleaning agent is forced to move along the center shaft portion toward the longitudinally rearward portion of the center shaft portion as the frame is propelled down the bore. This movement along the center shaft portion causes intimate contact between the cleaning agent and the bore.

5 Claims, 5 Drawing Sheets

(56) References Cited

U.S. PATENT DOCUMENTS 3,209,690 A * 10/1965 Mercatoris, Jr. ..... F41A 29/00 102/442
3,217,648 A 11/1965 Foote et al.
3,285,174 A * 11/1966 Moehlman ..... F42B 7/08 102/451
3,326,133 A * 6/1967 Stadler ..... F42B 8/02 102/529
3,476,047 A 11/1969 Davis
3,682,556 A 8/1972 Hanson
3,740,883 A * 6/1973 Kyle ..... F42B 5/24 102/442
4,328,632 A 5/1982 Beers
4,513,668 A * 4/1985 Fuller ..... F42B 5/24 102/511
4,843,750 A 7/1989 Blase
4,998,368 A 3/1991 Blase
5,164,539 A 11/1992 French
5,233,128 A 8/1993 Lai
5,341,744 A * 8/1994 Shi ..... F42B 5/24 102/430
5,777,258 A * 7/1998 Soon ..... F42B 5/24 102/442
5,883,329 A * 3/1999 O'Dwyer ..... F41A 19/65 102/217
5,907,121 A * 5/1999 Fritze ..... F42B 5/025 102/435
5,970,878 A 10/1999 Gardner
6,105,591 A 8/2000 Decare et al.
6,389,978 B1 * 5/2002 Hooper ..... F42B 5/24 102/440
7,131,381 B1 11/2006 Nafziger
7,150,229 B2 12/2006 Gardner
7,197,986 B1 * 4/2007 Calkins ..... F41A 21/22 102/435
7,451,707 B1 * 11/2008 Hadden ..... F41A 29/02 102/442
7,707,942 B1 5/2010 Gardner
7,743,706 B1 6/2010 Lai
8,051,776 B1 * 11/2011 Bailey ..... F42B 3/006 102/442
9,052,172 B2 6/2015 Whitworth
9,194,674 B2 * 11/2015 Whitworth ..... F42B 5/24
9,212,879 B2 * 12/2015 Whitworth ..... F42B 14/00
2002/0129725 A1 9/2002 Bice et al.
2004/0244627 A1 12/2004 Bice et al.
2014/0109791 A1 * 4/2014 Whitworth ..... F42B 7/08 102/529
2014/0130699 A1 * 5/2014 Peterson ..... F41A 3/00 102/520
2014/0331886 A1 11/2014 Whitworth
2015/0268021 A1 * 9/2015 Whitworth ..... F42B 5/24 102/529

* cited by examiner

FIREARM CLEANING SHELL

TECHNICAL FIELD

The present disclosure relates to a device for removing material such as carbon, lead, metals, and plastic contaminants from a bore of a firearm, and more particularly relates to a projectile having a tapered cone-shaped center shaft portion forcing outward, radial intimate contact between one or more cleaning agents and the bore of the firearm.

BACKGROUND

The statements in this section merely provide background information related to the present disclosure. Accordingly, such statements are not intended to constitute an admission of prior art.

Cleaning the bore of a firearm after use is generally required to prevent possible damage due to corrosion to the bore. It is often true that the task of manually cleaning a firearm is most undesirable when the condition of the firearm is most suitable for bore damage; for example at the end of an outing under inclement conditions. The task of manually cleaning the bore of a firearm is time consuming and may require disassembly of the firearm. Therefore there is a need among users of firearms for a convenient, quick, easily used and effective device for cleaning a bore of moisture, powder residue and foreign material which contributes to the corrosion within a bore until a more complete manual cleaning may be accomplished.

Embodiments are known in the art to propel material down the barrel of a firearm to clean the bore of the gun. These devices, however, rely on compacted wadding to sufficiently wipe down the inner wall of the bore as they travel therethrough. To fit within a shell capable of being fired from a particular firearm inherently requires that the wadding and other materials be compacted to be smaller in rough diameter than the bore they are intended to clean. This results in an ineffectively cleaning of the bore as portions of the bore are not wiped by the intended cleaning components.

Further, these devices also generally comprise stacked layers of wadding and other materials which are either pre-moistened with a cleaner or lubricant which reduces the shelf life of product.

SUMMARY

A bore cleaning projectile cleans a bore of a firearm as the projectile is propelled down the bore. The projectile includes a frame including a lower charge cap, a tapered cone-shaped center shaft portion, and an end cap. The projectile further includes a propellant providing a force to push the device down the bore of the firearm and at least one cleaning agent situated around the tapered cone-shaped center shaft portion. The center shaft portion includes a narrower diameter at a longitudinally forward portion of the center shaft portion and a wider diameter at a longitudinally rearward portion of the center shaft portion. The cleaning agent is forced to move along the center shaft portion toward the longitudinally rearward portion of the center shaft portion as the frame is propelled down the bore. This movement along the center shaft portion causes intimate contact between the cleaning agent and the bore.

BRIEF DESCRIPTION OF THE DRAWINGS

One or more embodiments will now be described, by way of example, with reference to the accompanying drawings, in which.

DETAILED DESCRIPTION

Figure 1:
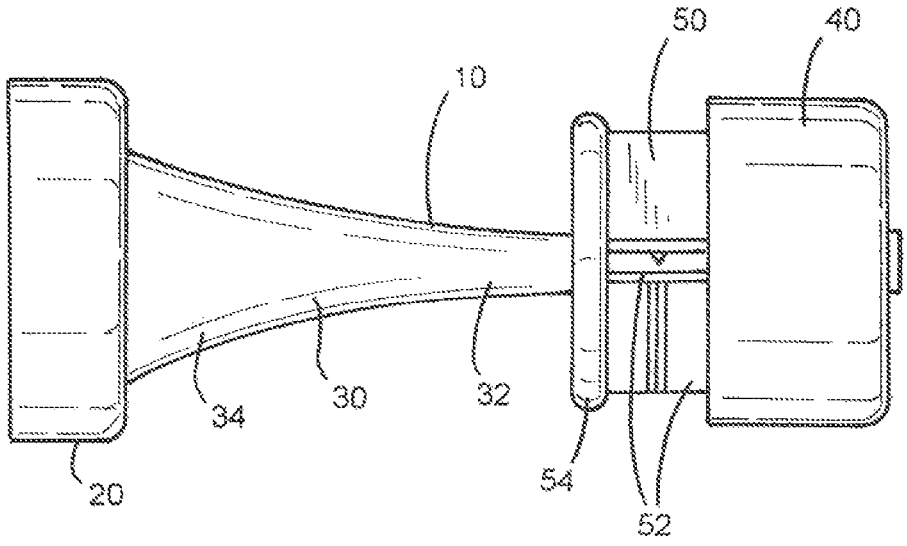
FIG. 1 illustrates an exemplary embodiment of a projectile frame configured to be propelled down a bore of a firearm, the frame including tapered cone-shaped center shaft portion and a collapsing table portion, in accordance with the present disclosure.

Referring now to the drawings, wherein the showings are for the purpose of illustrating certain exemplary embodiments only and not for the purpose of limiting the same, a bore cleaning projectile can be used to wipe or scrub contaminants from the bore of a firearm. Contaminants in a bore can include gunpowder residue, lead or copper from bullets fired through the bore, brass shavings from shell casings, plastic shavings or dust from shotgun shell casings, dirt or other intrusive contaminants, and/or corrosion within the bore caused by humidity interacting with the material of the firearm barrel. Scrubbing brushes and materials are known for use in cleaning out a bore, wherein the operator of the firearm disassembles the firearm and pushes or pulls cleaning materials through the bore. Cleaning solvents and/or lubricating liquids can be used to aid in the cleaning process.

Utilizing a projectile configured to clean contaminants from the bore of the firearm can be beneficial in that the projectile can be fired and the bore cleaned without the firearm being disassembled. Such a feature can be a convenience, saving time of the operator. Such a feature can increase the operating life of the firearm, as diassembling and reassembling the firearm can be a source of damage or wear upon the firearm. Such a feature can be lifesaving, for example, in combat, wherein the readiness of the soldier using the firearm can be put at risk if the firearm requires disassembly due to contamination.

Projectiles used to clean the bore of a firearm need to able to be loaded in to the firearm and cycled as would a normal round of ammunition. As a result, the projectile must fit within a shell casing typical to a round of ammunition, and the projectile must be shaped to easily slide out of the casing and into the bore of the firearm. However, such a projectile is inherently smaller than the caliber of the bore through which the projectile is being fired. As a result, interaction of the projectile with the bore can be less than desired. As a result, the scrubbing that needs to take place to effectively clean the bore can fail to take place.

A round of ammunition includes a propellant, which when activated, provides a quickly expanding gas that is used to propel a bullet down the bore. A cleaning projectile is disclosed including a projectile frame including a tapered cone-shaped center shaft portion. Cleaning agents including disk shaped polymer wipers and/or cylindrically shaped fibrous cleaning pads can be fitted around the tapered cone-shaped center shaft portion. As the projectile is propelled down the bore of the firearm, friction and inertia cause the cleaning agents to be pulled backward along the projectile frame and up upon an increasing diameter of the tapered cone-shaped center shaft portion. This movement of the cleaning agents along the frame upon the increasing diameter of the tapered cone-shaped center shaft portion causes an outer diameter of each of the cleaning agents to increase and be forced against the bore of the firearm. This forcing of the cleaning agents against the bore of the firearm increases contact and cleaning effectiveness of the cleaning agents as they move down the bore.

The disclosed projectile can be used in a wide variety of firearms, including smoothbore shotgun barrels, rifled shotgun barrels (for example, as used with rifled deer slugs), and rifled firearms such as .223 caliber long-arms and 9 mm caliber handguns. The dimensions of the projectile need to be altered to a particular firearm, and a density or material choice of cleaning agents may change in order to most effectively clean within the grooves of a particular rifling pattern within a bore, but the overall configuration of the projectile and the related components work within virtually any firearm.

FIG. 1 illustrates an exemplary embodiment of a projectile frame configured to be propelled down a bore of a firearm, the frame including tapered cone-shaped center shaft portion and a collapsing table portion. Projectile frame 10 is illustrated including lower charge cap 20, tapered cone-shaped center shaft portion 30, end cap 40, and collapsing table portion 50. A propellant acts upon lower charge cap 20 and pushes frame 10 down the bore of the firearm in the direction of end cap 40. Lower charge cap 20 can include a cup shaped depression on the illustrated left end of frame 10. Tapered cone-shaped center shaft portion 30 includes a narrow diameter front portion 32 and a wide diameter rear portion 34. Collapsing table portion 50 includes four exemplary creased walls 52 configured to collapse when a propellant applies a propelling/crushing force upon the frame 10 as the frame is propelled down the bore. Creased walls 52 connect rear table portion 54 to end cap 40. Frangible capsules can be placed within cavity features of collapsing table portion 50, such that when the creased walls 52 collapse, the frangible capsules are crushed and release a liquid or powder agent within the capsules. The liquid or powder agent can include any detergent or oil product known in the art for cleaning or lubricating a bore of a firearm.

Figure 2:
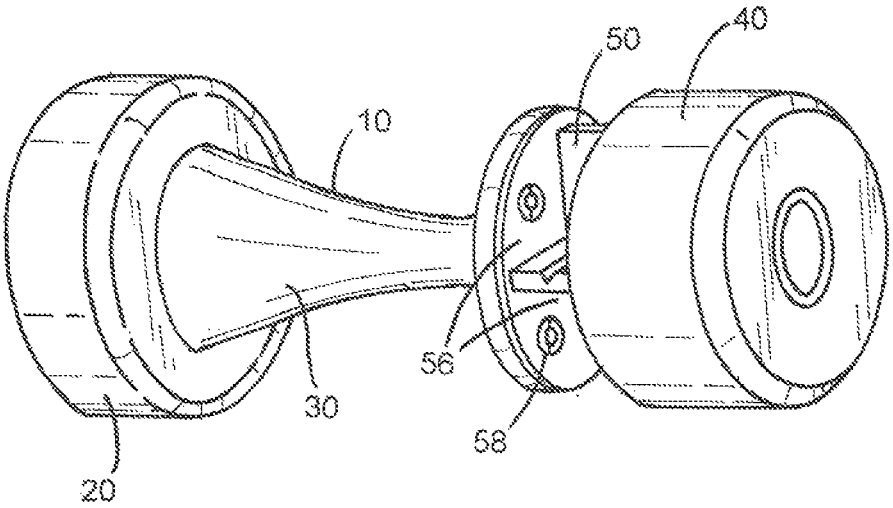
FIG. 2 illustrates in a perspective view the projectile frame of FIG. 1, in accordance with the present disclosure.

FIG. 2 illustrates in a perspective view the projectile frame of FIG. 1. Projectile frame 10 is illustrated including lower charge cap 20, tapered cone-shaped center shaft portion 30, end cap 40, and collapsing table portion 50. Cavity portions 56 of the collapsing table portion 50 are illustrated including optional dimple depressions 58 configured to aid in keeping frangible capsules in a desired location within the cavities.

Figure 3:
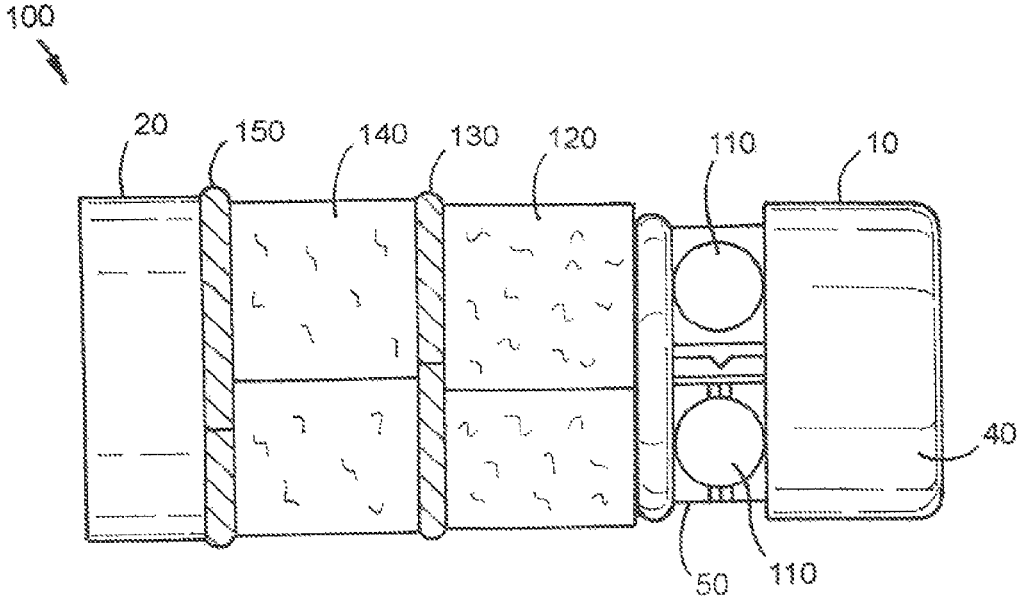
FIG. 3 illustrates and exemplary projectile assembly including the projectile frame of FIG. 1 with cylindrically or disk shaped cleaning agents installed to the center shaft portion of the frame and with frangible capsules installed to the collapsing table portion of the frame, in accordance with the present disclosure.

FIG. 3 illustrates and exemplary projectile assembly including the projectile frame of FIG. 1 with cylindrically or disk shaped cleaning agents installed to the center shaft portion of the frame and with frangible capsules installed to the collapsing table portion of the frame. Projectile assembly 100 is illustrated including frame 10, cleaning agents 120, 130, 140, and 150, and frangible capsules 110. Cleaning agent 120 can include an exemplary abrasive or course fiber pad. This agent 120 when pressed against a bore of a firearm provides a scrubbing cleaning function. Cleaning agent 140 can include an exemplary absorbent pad such as a high density felt matting pad. Agent 140 when pressed against a bore of a firearm further cleans the bore and absorbs cleaning or lubricating agents released from frangible capsules 110. Cleaning agents 130 and 150 include disk shaped polymerized or rubberized wipers which, when pressed against the bore of the firearm, sweep away particulate matter from the bore. Frangible capsules 110 can be constructed similarly to paint balls used in recreational sports and are configured to easily crush and release a cleaning liquid or powder.

Figure 4:
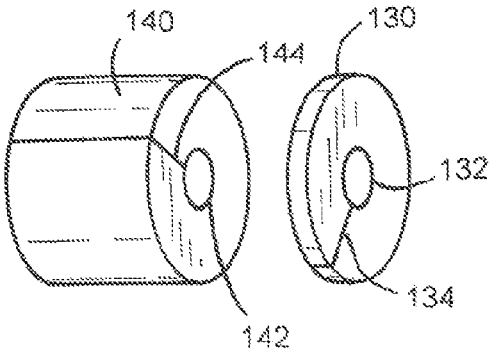
FIG. 4 illustrates two of the cleaning agents of FIG. 3, in accordance with the present disclosure.

FIG. 4 illustrates two of the cleaning agents of FIG. 3. Cleaning agent 140 is illustrated comprising a cylindrically shaped pad. A center hole 142 and a slot 144 are illustrated. Center hole 142 is configured to a size/shape of the center shaft of frame 10 that is situated within the hole 142 when the pad is installed to the center shaft. Cleaning agent 130 is illustrated comprising a disk shaped polymerized or rubberized washer. A center hole 132 and a slot 134 are illustrated. Center hole 132 is configured to a size/shape of the center shaft of frame 10 that is situated within the hole 132 when the pad is installed to the center shaft. Hole 132 can be smaller than hole 142 because cleaning agent 130 is situated in front of or on a narrower portion of the center shaft than cleaning agent 140. In one embodiment, the two illustrated cleaning agents could be used without claiming agents 120 or 150, with the length of cleaning agent 140 being modified to fill the gap between end cap 40 and lower charge cap 20. Any number of exemplary cleaning agent configurations are envisioned, and the disclosure is not intended to be limited to particular examples provided herein.

Figure 5:
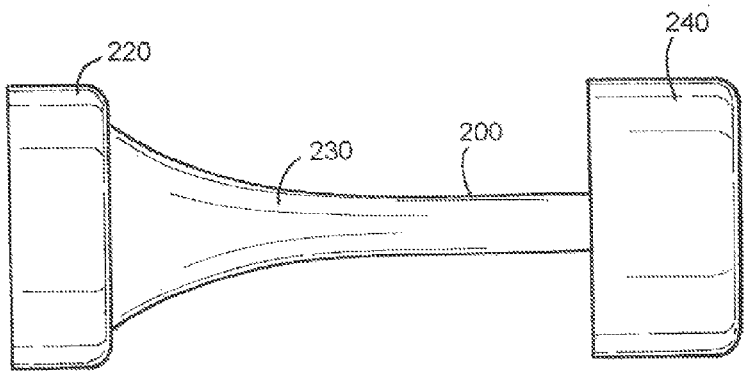
FIG. 5 illustrates an exemplary alternative embodiment of a projectile frame configured to be propelled down a bore of a firearm, the frame including tapered cone-shaped center shaft portion without a collapsing table portion, in accordance with the present disclosure.

FIG. 5 illustrates an exemplary alternative embodiment of a projectile frame configured to be propelled down a bore of a firearm, the frame including tapered cone-shaped center shaft portion without a collapsing table portion. Projectile frame 200 is illustrated including lower charge cap 220, tapered cone-shaped center shaft portion 230, and end cap 240. Cleaning agents similar to cleaning agents 120, 130, 140, and 150 can be installed to center shaft portion 230. Cleaning agents can optionally be pre-moistened with a liquid cleaning or lubricating product, or a cleaning powder can be pre-applied to the cleaning agents.

Figure 6:
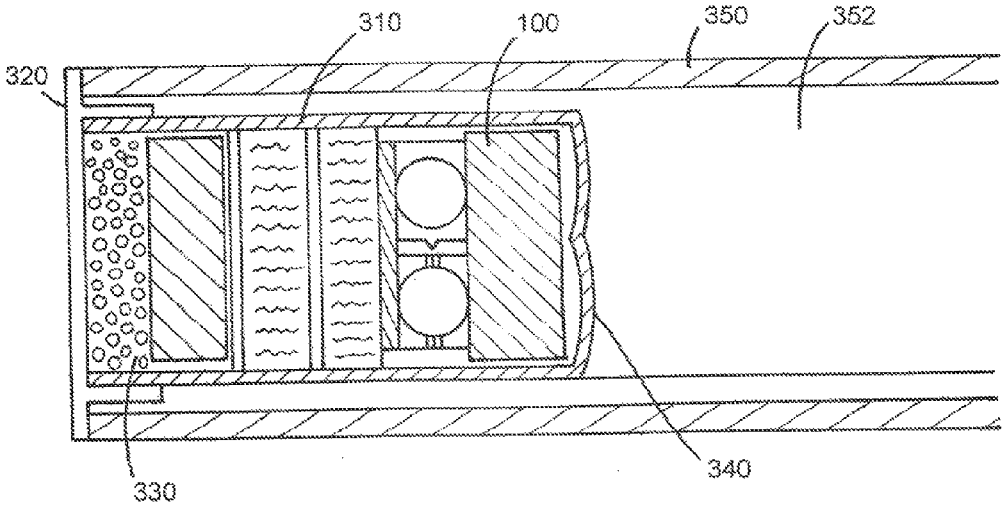
FIG. 6 illustrates the projectile assembly of FIG. 3 provided within a shell casing to the breach of a firearm, in accordance with the present disclosure.

FIG. 6 illustrates the projectile assembly of FIG. 3 provided within a shell casing to the breach of a firearm.

Firearm barrel 350 is illustrated including bore 352. Projectile assembly 100 is illustrated provided within shell casing 310 including end cap 320. Propellant 330 is provided within casing 310 between end cap 320 and projectile assembly 100. Casing 310 includes closed top 340 configured to easily release projectile assembly 100 when propellant 330 is activated.

Figure 7:
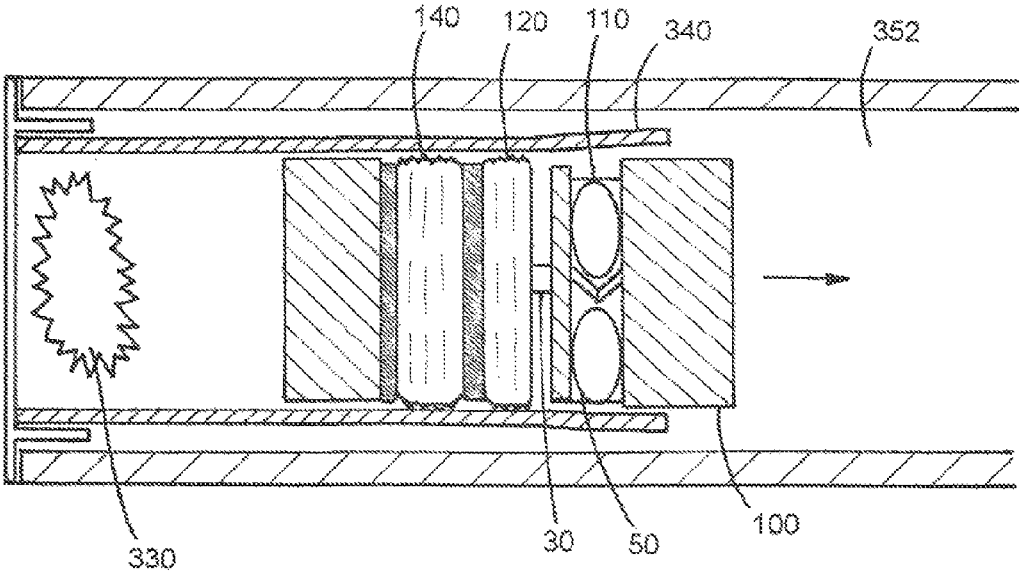
FIG. 7 illustrates the projectile assembly of FIG. 6 being expelled from the shell casing down a bore of the firearm, in accordance with the present disclosure.

FIG. 7 illustrates the projectile assembly of FIG. 6 being expelled from the shell casing down a bore of the firearm. Projectile assembly 100 is illustrated being forced through closed top 340 by activation of propellant 330 and beginning to travel down bore 352. Inertia, friction, and back pressure upon projectile assembly 100 cause collapsing table feature 50 to begin to collapse, and frangible capsules 110 are illustrated being flattened by the table. Further, friction and inertia act upon cleaning agents 120 and 140, such that both are longitudinally flattened and move rearward along the projectile frame to portions of increasing diameter upon the cone-shaped center shaft portion 30 of the frame of projectile assembly 100, such that a small portion of the center shaft portion 30 can be seen.

Figure 8:
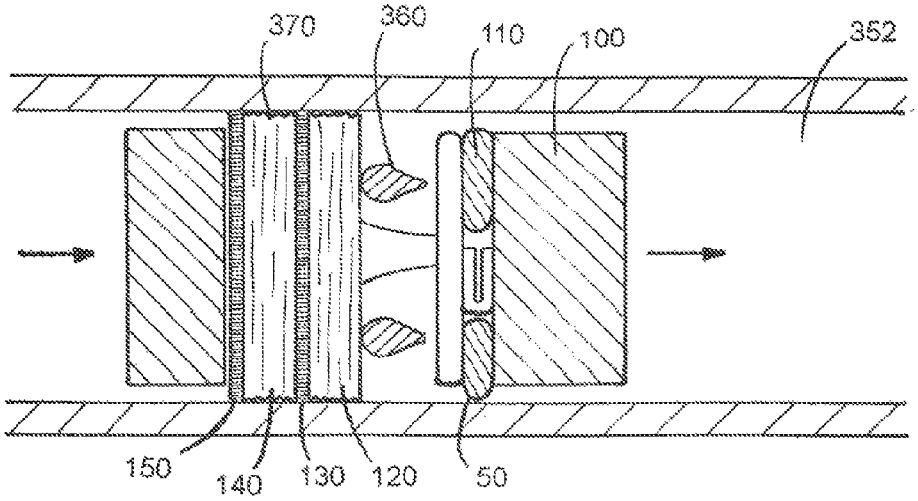
FIG. 8 illustrates the projectile assembly of FIG. 6 being propelled down the bore of the firearm, with cleaning agents of the projectile assembly being forced outward by the tapered cone-shaped center shaft portion of the frame of the assembly, the outward force causing intimate contact between the cleaning agents and the bore and with a propelling force being applied to the frame collapsing the collapsing table portion of the frame, thereby crushing the frangible capsules of the assembly, in accordance with the present disclosure.

FIG. 8 illustrates the projectile assembly of FIG. 6 being propelled down the bore of the firearm, with cleaning agents of the projectile assembly being forced outward by the tapered cone-shaped center shaft portion of the frame of the assembly, the outward force causing intimate contact between the cleaning agents and the bore and with a propelling force being applied to the frame collapsing the collapsing table portion of the frame, thereby crushing the frangible capsules of the assembly. Projectile assembly 100 is illustrated including collapsing table portion 50 illustrated in a collapsed state, frangible capsules 110 crushed with capsule liquid 360 released, and with cleaning agents 120, 130, 140, and 150 compressed and moved rearward along the center shaft portion of projectile assembly 100. Cleaning agents 120, 130, 140, and 150 are forced radially outward from the frame of projectile assembly 100, such that the cleaning agents are forced into intimate contact at surface 370 with the bore 352 of the firearm.

Figure 9:
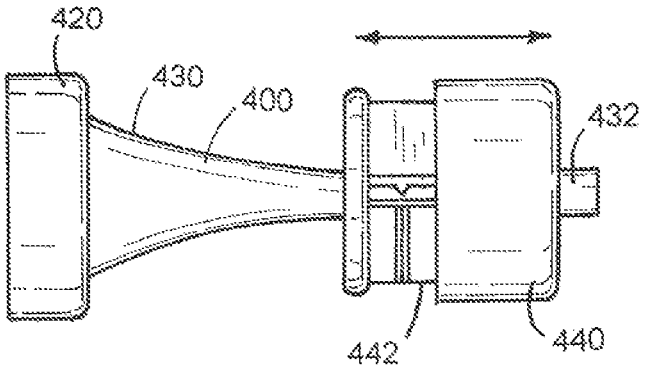
FIG. 9 illustrates an exemplary alternative embodiment of a projectile frame configured to be propelled down a bore of a firearm, including an end cap configured to slide along a central post, in accordance with the present disclosure.

FIG. 9 illustrates an exemplary alternative embodiment of a projectile frame configured to be propelled down a bore of a firearm, including an end cap configured to slide along a central post. Frame 400 is illustrated including lower charge cap 420, tapered cone-shaped center shaft portion 430 including shaft end 432, and sliding end cap 440. Sliding end cap 440 includes a hole through a longitudinally oriented center of the cap, such that shaft end 432 can be inserted within the hole. Cap 440 can slide along shaft end 432, can be initially aligned with an end of the shaft end 432, and can slide toward lower charge cap 420 as the frame is propelled down a bore. Sliding end cap 440 can optionally include collapsing table portion 442 wherein frangible capsules can be placed and subsequently crushed during process of being propelled down the bore according to the disclosure.

Figure 10:
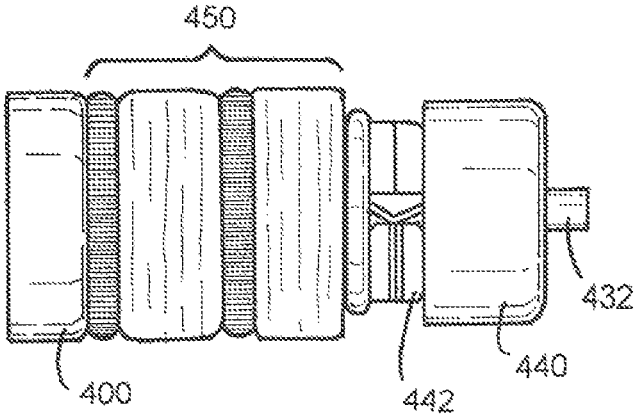
FIG. 10 illustrates the exemplary projectile frame of FIG. 9, with the end cap compressing a set of cleaning agents and with a collapsing table of the end cap collapsing, in accordance with the present disclosure.

FIG. 10 illustrates the exemplary projectile frame of FIG. 9, with the end cap compressing a set of cleaning agents and with a collapsing table of the end cap collapsing. Frame 400 is illustrated with cleaning agents 450 assembled to a center shaft portion of frame 400. As sliding end cap 440 slides along shaft end 432, cleaning agents 450 are compressed and forced to expand in a radially outward direction, forcing intimate contact between the cleaning agents and the bore. Further, collapsing table portion 442 is illustrated collapsing, which would act to crush any frangible capsules installed to the collapsing table portion. It will be appreciated that the cleaning agents 450 are exemplary. Any number of fibrous cylinders or rubberized wipers can be used according to the disclosed apparatus.

The illustrated tapered cone-shaped center shaft of the figures is provided with exemplary dimensions and geometry. It will be appreciated that the amount of taper, the thickness of the shaft in different positions, etc. are exemplary and the disclosure intends to incorporate any and all tapered configurations and geometries.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a bore cleaning device configured to clean a bore of a firearm, the device comprising:

a frame comprising:

an end cap at a longitudinally forward end of the frame;

a center shaft portion comprising:

a narrower diameter portion at a longitudinally forward end of the center shaft portion;

a wider diameter portion at a longitudinally rearward end of the center shaft portion; and a tapered cone-shaped middle portion between the narrower diameter portion and the wider diameter portion, the middle portion gradually increasing in diameter from the narrow diameter portion to the wider diameter portion; and a lower charge cap at a longitudinally rearward end of the frame, the lower charge cap connected to the wider diameter portion;

a propellant providing a force to push the device down the bore of the firearm; and at least one cleaning agent situated around the center shaft portion;

wherein the cleaning agent is forced to move along the center shaft portion toward the wider diameter portion of the center shaft portion as the frame is propelled down the bore, the movement forcing the cleaning agent radially outward and causing intimate contact between the cleaning agent and the bore.

2. The apparatus of claim 1, wherein the end cap comprises a collapsing table portion; and further comprising at least one frangible capsule located within the collapsing table portion.

3. The apparatus of claim 1, wherein the end cap is configured to slide along the center shaft portion.

4. The apparatus of claim 1, further comprising a plurality of cleaning agents situated around the center shaft portion.

5. The apparatus of claim 4, wherein the cleaning agents comprise a cylindrically-shaped fibrous cleaning agent, a cylindrically-shaped high density felt cleaning agent, and two disk-shaped rubberized wipers.

* * * * *